US009341170B2

(12) United States Patent
Krebs

(10) Patent No.: US 9,341,170 B2
(45) Date of Patent: May 17, 2016

(54) AXIAL PISTON MACHINE

(75) Inventor: Clemens Krebs, Tuebingen (DE)

(73) Assignee: Robert Bosch GmbH, Stuttgart (DE)

( * ) Notice: Subject to any disclaimer, the term of this patent is extended or adjusted under 35 U.S.C. 154(b) by 478 days.

(21) Appl. No.: 13/823,451

(22) PCT Filed: Aug. 5, 2011

(86) PCT No.: PCT/EP2011/003927

§ 371 (c)(1),
(2), (4) Date: Jun. 10, 2013

(87) PCT Pub. No.: WO2012/034619

PCT Pub. Date: Mar. 22, 2012

(65) Prior Publication Data

US 2013/0298754 A1 Nov. 14, 2013

(30) Foreign Application Priority Data

Sep. 17, 2010 (DE) ..... 10 2010 045 867

(51) Int. Cl.
*F04B 1/20* (2006.01)
*F04B 1/22* (2006.01)
*F04B 23/14* (2006.01)

(52) U.S. Cl.
CPC ..... *F04B 1/205* (2013.01); *F04B 1/2021* (2013.01); *F04B 1/2042* (2013.01); *F04B 1/22* (2013.01); *F04B 23/14* (2013.01)

(58) Field of Classification Search
CPC ..... F04B 1/122; F04B 1/205; F04B 1/2057; F04B 1/2021; F04B 1/2014; F04B 1/2064; F04B 1/2071; F04B 1/2028
See application file for complete search history.

(56) References Cited

U.S. PATENT DOCUMENTS 2,633,104 A * 3/1953 Lauck et al. ..... 91/505
3,199,461 A * 8/1965 Wolf ..... 91/6.5

(Continued)

FOREIGN PATENT DOCUMENTS

DE 195 36 997 C1 2/1997
DE 10 2005 059 565 A1 6/2007

(Continued)

OTHER PUBLICATIONS

Hoffmeister, U.S. Appl. No. 13/823,451 Jun. 29, 2015 DE 19536997 C1 I Mach Translation, Feb. 1997.*
International Search Report corresponding to PCT Application No. PCT/EP2011/003927, mailed Oct. 26, 2011 (German and English language document) (8 pages).

*Primary Examiner* — Devon Kramer
*Assistant Examiner* — Kenneth J Hansen
(74) *Attorney, Agent, or Firm* — Maginot, Moore & Beck LLP

(57) ABSTRACT

An axial piston machine includes a housing part, a drive shaft, which is mounted in the housing part, and a cylinder drum, which is connected to the drive shaft in a rotationally fixed manner and which accommodates a plurality of pistons. Each of the pistons bound a working chamber and are supported on a swashplate. The working chambers can be connected in alternation to a high-pressure channel and to a low-pressure channel, which extend in the housing part. An insert part is rigidly inserted into the housing part. A control surface of the insert part is directly opposite the cylinder drum. The insert part has a high-pressure channel section and a low-pressure channel section, which have approximately kidney-shaped opening areas in the control surface. The other openings of the high-pressure and low-pressure channel sections opposite the opening area in the control surface are formed radially on the insert part.

11 Claims, 6 Drawing Sheets

(56) References Cited

U.S. PATENT DOCUMENTS

| | | | | | |
|---|---|---|---|---|---|
| 4,920,856 | A | * | 5/1990 | Berthold et al. | 91/6.5 |
| 5,598,761 | A | * | 2/1997 | Kristensen et al. | 92/57 |
| 5,681,149 | A | * | 10/1997 | Weatherly | 417/269 |
| 5,807,080 | A | | 9/1998 | Ochiai et al. | |
| 7,257,948 | B1 | | 8/2007 | Bennett | |

FOREIGN PATENT DOCUMENTS

| | | | |
|---|---|---|---|
| DE | 10 2006 062 065 | A1 | 7/2008 |
| JP | 59-20577 | A | 2/1984 |

* cited by examiner

AXIAL PISTON MACHINE

This application is a 35 U.S.C. §371 National Stage Application of PCT/EP2011/003927, filed on Aug. 5, 2011, which claims the benefit of priority to Serial No. DE 10 2010 045 867.8, filed on Sep. 17, 2010 in Germany, the disclosures of which are incorporated herein by reference in their entirety.

BACKGROUND

The disclosure relates to an axial piston machine as described below and to an insert part which is suitable for such an axial piston machine.

An axial piston machine is known, for example, from DE 10 2006 062 065 A1 195 36 997 C1 and datasheet RDE 93220-04-R/02.08 by Bosch Rexroth AG and can be embodied as a single or double axial piston machine and as a pump or motor. In these known solutions, the axial piston machine is embodied with a housing in which at least one cylinder drum with a multiplicity of pistons which each bound one working chamber is rotatably mounted. These pistons are each supported by means of a piston foot on a swash plate whose attitude angle determines the piston stroke.

The working chamber which is bounded in each case by a piston can be alternately connected to a high pressure duct and to a low pressure duct via a control disk which is arranged at the end of the housing. The cylinder drum is connected in a rotationally fixed fashion to a drive shaft which, depending on the type of machine (motor, pump), acts either as an output shaft or as a drive shaft.

In the abovementioned axial piston machines, the housing has a housing part which is for example pot shaped or double pot shaped and in whose pot bottom the high pressure ducts and low pressure ducts are formed, it being possible to connect said high pressure ducts and low pressure ducts in series to the working chambers of the cylinder drum via the control disk which is fixed with respect to the rotating cylinder drum. In other axial piston machines, the part of the housing in which the pressure ducts are formed can also be embodied in a plate shape.

In the control disk, a plurality of comparatively small pressure kidneys which lie on a common pitch circle and between each of which a material web is arranged are formed. On the low pressure side, each control disk is embodied with a suction kidney which extends over a circumferential angle range which is relatively large compared to the small pressure kidneys.

U.S. Pat. No. 7,257,948 B1 presents a double axial piston machine in which a charging pump which is embodied as an internally toothed gearwheel machine is arranged between two pump units. The charging pump is arranged here between two disks which are fixedly connected to the housing. The disks here have the pressure kidneys described above and a suction kidney and form at the same time the housing of the axial piston machine in this region, i.e. they are not radially surrounded by the housing or a housing part. On the drum side, each disk bears against the assigned cylinder drum.

It is disadvantageous here that the disks are not surrounded by a housing, with the result that bearing faces of the disks against the charging pump are at risk of soiling.

DE 195 36 997 C1 presents a double axial piston pump having two pump units in a swash plate configuration in which the housing has a disk-shaped central housing part in which the two drive shafts of the two units are connected to one another in a rotationally fixed fashion. An impeller wheel or impeller of a charging pump, by means of which a charging pressure can be applied for both units to the pressure medium on the low pressure side, is mounted in this region between the two shafts. In order to mount the impeller wheel, the housing part is embodied on the side of a first unit with an insert ring which is mounted after the impeller wheel is inserted into the housing part. In this insert ring, high pressure duct sections and low pressure duct sections which are assigned to the cylinder drum of the first unit are formed, said duct sections having a pressure medium conducting connection on the side of the central housing part to a high pressure duct and low pressure duct arranged in the housing part. In the second pump unit, these high pressure duct sections and low pressure duct sections are formed in the wall of the housing part.

Working chambers of the two cylinder drums can be alternately connected to the high pressure duct section and the low pressure duct section of the housing or the insert ring via a control disk which is arranged on the end side of the central housing part (second pump unit) or on the end side of the insert ring (first pump unit). In the control disk, a plurality of comparatively small pressure kidneys which are located on a common pitch circle are formed on the high pressure side, in each case a material web being arranged between said pressure kidneys. On the low pressure side, each control disk is embodied with a suction kidney which extends over a circumferential angle range which is relatively large in comparison with the small pressure kidneys.

The two control disks are of a very thin configuration here and bear with an axial bearing face, which has been ground with high precision, on a likewise precise axial bearing face of the insert ring or of the central housing part. On the drum side, the control disks are likewise fabricated and ground in a very precise spherically convex fashion.

During operation of the axial piston machine, comparatively high pressures are applied to the high pressure ducts in the central housing part, in the region of the pressure kidneys and of the material webs adjoining the latter. It is problematic here that as a rule the housing part is manufactured from ductile graphite, and that precisely in this region one zone is present which is problematic with respect to the casting front profile and in which cavity points can occur during hardening of the casting. In the case of high stresses owing to a high hydraulic pressure, damage or deformation of the housing part can then occur in the region where cavities are present, with the result that the running time of the axial piston machine is reduced.

A disadvantage of the solution is that the control disk, the insert ring and the housing part against which the control disk bears can only be fabricated at very high cost with the required precision and pressure resistance and take up a relatively large amount of space in the axial direction.

In contrast with the above, the disclosure is based on the object of providing an axial piston machine with a shortened overall length and simplified fabrication and in which the risk of damage by pressure loading is reduced.

This object is achieved by means of an axial piston machine having the features described below. The object is also achieved by an insert part having the features described below.

Further advantageous refinements of the disclosure are described below.

SUMMARY

The axial piston machine according to the disclosure has a housing part in which a cylinder drum which is connected to a drive shaft in a rotationally fixed fashion is mounted. The cylinder drum has a multiplicity of pistons which each bound one working chamber and are supported on a swash plate. In this context, during one rotation of the drum the working chambers can alternately be connected to a high pressure duct and to a low pressure duct via a high pressure duct section and a low pressure duct section of an insert part which is fixed to the housing or fixedly arranged in the housing, said pressure ducts extending in the housing part. The expression "extending in the housing part" also includes here the fact that the ducts also extend in further parts which are recessed into the housing part. According to the disclosure, the insert part is located with a control face directly opposite the cylinder drum, wherein the high pressure duct section and the low pressure duct section have approximately kidney-shaped mouth regions in the control face. The insert part bears directly against the cylinder drum if the lubrication film which is formed between the insert part and the cylinder drum during operation is considered to be insignificant for the approach.

The insert part combines the function of an insert ring and the function of a control disk in a single, compact component by virtue of the fact that in the insert part the high pressure duct section tapers from a kidney-shaped mouth region to a circular-cylindrical mouth, and by virtue of the fact that by means of the insert part the working chambers of the cylinder drum are placed in a pressure medium conducting connection with the high pressure duct and the low pressure duct. This embodiment in a single part results in a lower degree of expenditure on fabrication, since instead of the conventional insert ring with a control disk now only one insert part has to be fabricated and processed. As a result of the fact that the insert ring and the control disk are fabricated in one piece as an insert part, the need to fabricate bearing faces between the two conventional parts (insert ring, control disk) is also eliminated. It is particularly advantageous here that the difficult fabrication or processing of the thin control disk is eliminated. The use of an insert part which is embodied in one piece in this way compared to a control disk which bears directly against the housing also contributes to higher pressure resistance of the housing since highly stressed regions around the high pressure connection are, according to the disclosure, not embodied in the housing or housing part but rather in the insert part, and the insert part can be dealt with significantly better in terms of shaping and reshaping. Finally, this configuration makes it possible to make the housing part comparatively thin-walled, while in the region of the zones which are stressed with high pressure the housing part is formed by the insert part. Given the same pressure resistance, relatively large duct cross sections are therefore also possible, which have a positive effect on the flow conditions in the machine and the efficiency of the machine. The specified advantages mean that the installation space and in particular the overall length of the total axial piston machine are shortened compared to the conventional solutions since they require very voluminous housings in order to make available the necessary pressure resistance.

In one preferred development of the disclosure, the high pressure duct section has an approximately circular-cylindrical mouth at its other end opposite the mouth region in the control face.

The control face of the insert part therefore bears against an end face of the cylinder drum in such a way that flat contact is formed between the insert part and the cylinder drum and the working chambers can be connected in a pressure-medium-tight fashion to the high pressure duct section or to the low pressure duct section in the insert part via the mouth region. The flat contact between the control face and the end face is embodied here in such a way that the cylinder drum can rotate together with the drive shaft without too much leakage between the cylinder drum and the insert part. In each case just a lubrication film is formed between the end face of the cylinder drum and the control face of the insert part.

In one advantageous development, a mouth region or the mouth regions has/have a fine adjustment geometry, in particular an adjustment groove which ends in the control face. The groove advantageously extends here approximately along a pitch circle which can be covered by both the mouth region and insert-part-side openings of the working chambers during the rotation of the cylinder drum. If the axial piston machine operates with different rotational directions of the drive shafts, it is additionally advantageous if fine adjustment geometries are provided on the mouth regions for both directions of rotation.

The control face is preferably of spherical configuration. It can be of concave or convex configuration. However, a planar control face is also possible.

In an advantageous development, the control face is embodied as an annular face which is raised with respect to a surface of the insert part facing the rest of the cylinder drum, in which annular face the mouth regions are located. As a result, just one small defined face bears against the cylinder drum, as a result of which the working chambers can be connected particularly reliably and in a way which can be checked satisfactorily, and in a pressure-medium-tight fashion to the high pressure duct section or the low pressure duct section in the insert part, with the exception of the leakage which is necessary to form the lubrication film.

In order to prevent pressure damage to the insert part or to the mouth regions, in one advantageous development of the disclosure in the mouth region of the high pressure duct section or of the low pressure duct section, one or more material webs (33) run between the radially inner boundary and the radially outer boundary.

In one particularly advantageous development, an end-face-side surface of the material webs is stepped back with respect to the control face. In this way, the surface of the material webs does not end flush with the control face and the recesses or control kidneys which are adjacent to the material webs have a pressure medium conducting connection directly to one another at the control face.

The low pressure duct section of the insert part preferably has a mouth region toward the housing part, in a circumferential face.

The mouth of the high pressure duct section is preferably formed in a circumferential face on the insert part.

The configuration of the axial piston machine can be simplified if a locating receptacle, into which a pressure bushing which extends into the housing part and in which the high pressure duct changes from the insert part into the housing part is inserted, is formed in the mouth of the high pressure duct section. As a result of the bushing, the position of the insert part with respect to the housing part can also be secured. It is particularly advantageous if the pressure bushing is stepped here with the result that such a load bearing face for the high pressure is provided that a force in the direction of the insert part acts on the pressure bushing.

In order to support the insert part axially against the housing, the insert part has a radial backstep via which an axial bearing face against the housing is formed. The insert part can also be centered radially in the housing by means of the radial backstep.

According to the disclosure it is preferred if a receptacle, into which a sliding bearing or roller bearing is inserted, is formed in the insert part, the drive shaft being mounted in the insert part and therefore in the housing part by means of said sliding bearing or roller bearing.

In one particular embodiment of the disclosure, the insert part is a steel casting, wherein preferably nitrated steel casting is used. It is also possible for the insert part to be a forged part or to be formed in a metal cutting fashion from a solid material and nitrated. Instead of a preferably used steel casting, ductile graphite or gray casting, in principle it is also possible to manufacture the housing from a simpler material, for example from lightweight metal.

An axial piston machine having the features disclosed herein can, in particular, also be embodied as a double axial piston machine with two units which are accommodated in a common housing part and which include at least one drive shaft and in each case a cylinder drum, wherein each unit is assigned an insert part according to at least one embodiment disclosed herein.

If each cylinder drum is assigned in each case a drive shaft, said drive shafts are preferably connected to one another in a rotationally fixed fashion at their opposite end sections via a coupling bushing, wherein the coupling bushing is preferably mounted in a rotatable fashion by means of a roller bearing or sliding bearing which is arranged in a receptacle of the two insert parts. In this context, the drive shafts can have external toothing which engages in internal toothing on the coupling bushing. The end sections of the shafts are preferably kept short here, as a result of which bending of the drive shaft can be compensated and is transmitted to the coupling bushing only to a limited degree. If the two drive shafts have identical end sections accommodated in the bushing, the two units can be mounted in two variants (on the left/on the right).

A charging pump, via which a charging pressure can be applied to a pressure medium flowing in on the low pressure side, can be arranged in the region between the cylinder drums, and wherein an impeller wheel of the charging pump forms an axial gap seal at least in certain sections with one or both insert parts.

It is preferred if the impeller or impeller wheel is connected to the coupling bushing in a rotationally fixed fashion. In this context it may, for example, be embodied in one piece with the bushing or be integrally formed onto the bushing.

The insert part according to the disclosure has a high pressure duct section with an end-side mouth region and an approximately circular-cylindrical radial mouth and is embodied in one piece. A blank of the insert part can be a casting which is formed in one piece here or can be composed from blanks of an insert ring and a control plate which are connected to one another in a materially joined fashion, for example by fusing or welding.

BRIEF DESCRIPTION OF THE DRAWINGS

A preferred exemplary embodiment of the disclosure will be explained in more detail below with reference to the drawings, in which.

DETAILED DESCRIPTION

Since the basic configuration of a double axial piston pump is sufficiently known from the prior art, for example such as from DE 195 36 997 C1, in the text which follows only the components which are essential to understanding the disclosure, and in particular a central region of the machine, are explained.

Figure 1:
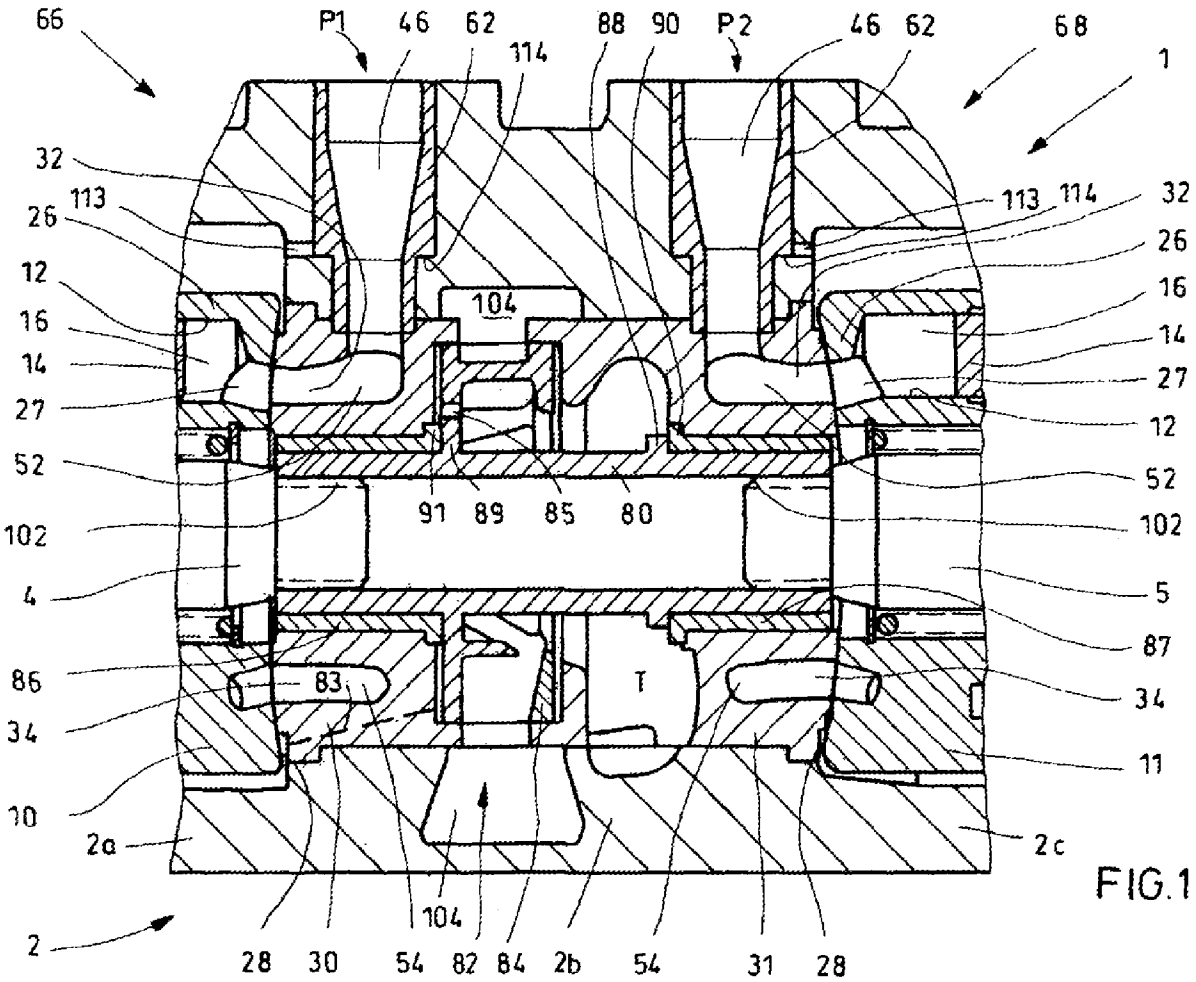
FIG. 1 shows a detailed illustration in a partial section along the longitudinal axis of a double axial piston pump.

The double axial piston pump 1 according to FIG. 1 has a multi-component housing, of which only the central, double-pot-like housing part 2 with housing sections 2*a*, 2*b* and 2*c* is shown partially in FIG. 1. The housing section 2*b* is a central part from which the housing sections 2*a* and 2*c* project in opposite directions. Two pump units 66 and 68 are arranged in the housing. A drive shaft 4 of the pump unit 66 is arranged and mounted in the housing section 2*a* and 2*b*, and a drive shaft 5 of the pump unit 68 is arranged and mounted in the housing section 2*b* and 2*c*. The approximately cylindrical housing sections 2*a* and 2*c*, which are fitted onto the central housing section 2*b*, form, together with external covers (not illustrated), a receptacle chamber for two cylinder drums 10, 11. The drive shafts 4, 5 have external toothing which engages in corresponding internal toothing (neither illustrated) of a cylinder drum 10, 11 in each case.

The cylinder drums 10, 11 have here a multiplicity of cylinder drilled holes 12 which are located on a common pitch circle and in each of which a piston 14 is guided. The latter bounds, together with the cylinder drilled hole 12, a working chamber 16 whose volume is dependent on the piston stroke. A piston foot (not illustrated), remote from the working chamber 16, of each piston 14 is connected in an articulated fashion to a sliding shoe (not illustrated). The latter bears against a swash plate (not illustrated either) which is mounted in a rotationally fixed fashion in the housing sections 2*a* and 2*c*, wherein the attitude angle of a bearing face on which the sliding shoes can slide determines the piston stroke. Depending on the configuration of the double axial piston pump 1, this attitude angle of the swash plates can be made either adjustable or invariable.

Each cylinder drum 10, 11 has, on its end side shown in FIG. 1, an end wall 26 in which a plurality of ducts 27, lying on a common pitch circle, are formed, which ducts 27 open, at one end, in each case in one of the working chambers 16 and, at the other end, in the outer end face 28 of the cylinder drums 10, 11. Both end faces 28 are of concavely spherical configuration. Each end face 28 of the cylinder drums 10, 11 of each pump unit 66, 68 bears, according to the disclosure, in a sliding fashion on insert parts 30, 31 which are mounted fixed to the housing and in each of which pressure kidneys 32 and a comparatively large suction kidney 34 are formed in a manner known per se. During the rotation of the cylinder drums 10, 11, the pressure kidneys 32 and the suction kidneys 34 alternately have a pressure medium conducting connection to the working chambers 16. The specific configuration of the insert parts 30, 31 is explained later on the basis of FIGS. 3 to 8.

The pump housing part 2 or, to be more precise, the central housing section 2*b* is subjected to considerable pressure forces during the operation of the axial piston pump, in particular in the regions adjoining the insert parts 30, 31. According to the disclosure, these pressure forces are taken up by the insert parts 30, 31, which are adapted to this pressure loading in terms of their geometry and material selection. As a result, it is possible to configure the central housing section 2*b* with a comparatively simple configuration which is easy to deal with in terms of casting technology.

In the central housing section 2*b*, there are two high pressure connections P1, P2, wherein the first pump unit is assigned to the high pressure connection P1, and the other pump unit is assigned to the high pressure connection P2. A tank connection (not shown in more detail) is common to both pump units. The high pressure connection P1, P2 of one unit 66, 68 is connected here to the abovementioned pressure kidneys 32 via, in each case, one high pressure duct (HP duct) 46 and one high pressure duct section (HP duct section) 52 arranged in the insert part 30, 31. The low pressure connection T of one unit 66, 68 is connected to the abovementioned suction kidney 34 via a low pressure duct (LP duct) (not illustrated) and a low pressure duct section (LP duct section) 54 arranged in the insert part 30, 31. In each case a pressure bushing 62 is inserted into both HP ducts 46. The two pressure bushings 62 are embodied in a step with an annular face 114, relieved of loading via, in each case, one relief drilled hole 113 toward the interior of the housing, on the step and are subjected to high pressure in such a way that a resultant of the pressure force, which acts radially into the interior of the double axial piston pump 1, occurs. An end section (at the bottom in FIG. 1) of the pressure bushings 62 bears here in a precisely fitting fashion on a locating face of the insert parts 30, 31 in such a way that the latter are fixed in position, in particular with respect to the angular position, by means of the pressure bushings 62.

The drive shafts 4, 5 have, on their end sections, external toothings 102 which mesh with an internal toothing of the coupling bushing 80. In this way, the drive shafts 4, 5 are connected to one another in a rotationally fixed fashion via the coupling bushing 80. The coupling bushing 80 is radially mounted by means of two sliding bearings 86, 87 in the two insert parts 30, 31. It also has two radially extended annular webs 88, 89, of which the annular web 88 is supported axially on an annular shoulder 90 of the sliding bearing 87, and the annular web 89 is supported axially on an annular shoulder 91 of the sliding bearing 86.

As is described, for example, in DE 195 36 997 C1, double axial piston machines of this type are embodied with a charging pump 82. In the specific solution, this charging pump 82 is formed by an impeller which is connected in a rotationally fixed fashion to the drive shafts 4, 5 via the coupling bushing 80 and via which a charging pressure is applied to the pressure medium on the suction side. An impeller wheel 84 is integrally formed on in one piece to the coupling bushing 80 here via the annular web 89. Pressure medium is sucked in from a suction chamber T via the impeller wheel 84 and fed into a charging pressure chamber 104. The charging pressure chamber 104 is connected via the suction-side LP duct sections 54 of the insert parts 30, 31 to the suction kidneys 34 thereof.

Figure 2:
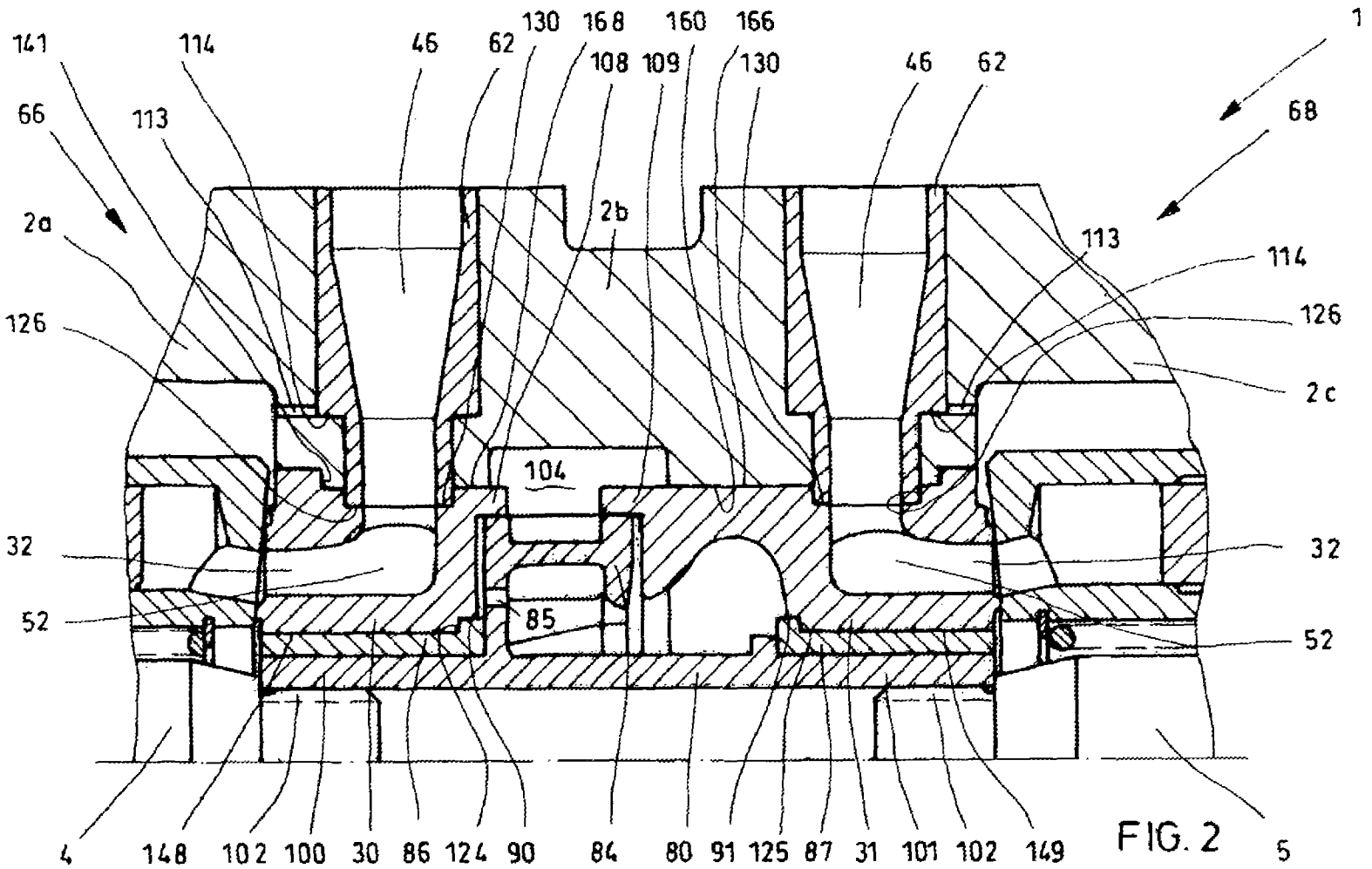
FIG. 2 shows a detailed illustration of the double axial piston pump according to FIG. 1 in an enlarged illustration.

FIG. 2 shows an enlarged partial illustration of the exemplary embodiment according to FIG. 1 in the region of the two pressure bushings 62. It is possible to see part of the impeller wheel 84 and of the coupling bushing 80. The coupling bushing 80 forms two hubs 100, 101 to the left and right in FIG. 2 in the region of which hubs 100, 101 the external toothing 102 of the drive shafts 4, 5 meshes with the internal toothing of the coupling bushing 80. According to this illustration, the insert parts 30, 31 have at their end side in each case a circumferential guide collar 108, 109, which protrudes with respect to the impeller wheel 84 and in each case covers the external circumference of the impeller wheel 84 in certain sections and forms a sealing gap therewith. The radial sealing gaps seal the charging pressure side of the impeller, on the one hand, with respect to a suction side of the impeller and, on the other hand, with respect to that in the interior of the housing in which the cylinder drum of the one unit is located. The hubs 100 and 101 of the impeller dip into the two sliding bearings 86, 87, which are each fitted into a receptacle 148, 149 of the insert parts 30, 31 and are supported axially with an annular end face 124, 125 of their annular shoulders 90, 91 in a radial extension of the receptacle 148, 149. The plan faces lying opposite the annular shoulders, on the annular webs 88 and 89, serve as an axial guiding means for the coupling bushing together with the impeller. Otherwise, there is a certain degree of play between the axial end faces of the impeller and the insert parts 30, 31. The flat annular chamber, brought about as a result of this, between the impeller and the insert part 30 and therefore the corresponding side face on the impeller are relieved of loading by the charging pressure by a drilled hole 85 in the impeller. Alternatively, the flat annular chamber can also be relieved of loading through the insert part 30 to the interior of the housing through a drilled hole 83 which is indicated by dashed lines in FIG. 1.

The two identical pressure bushings 62 are subjected to the high pressure on an excess face radially toward the inside (at the bottom of FIG. 2), with the result that they are always acted on in the direction of the associated insert part 30, 31. The end section of the pressure bushings 62 which is embodied with an annular end face 126 dips into a corresponding radial locating receptacle 130 of the insert parts 30 and 31, with the result that the insert parts 30, 31 are secured with respect to the angular position. Their radial centering occurs in each case by means of their circular-cylindrical external circumferential faces 166, 168 with which they are inserted into a continuous locating drilled hole 160 in the central housing section 2*b*.

Figure 3:
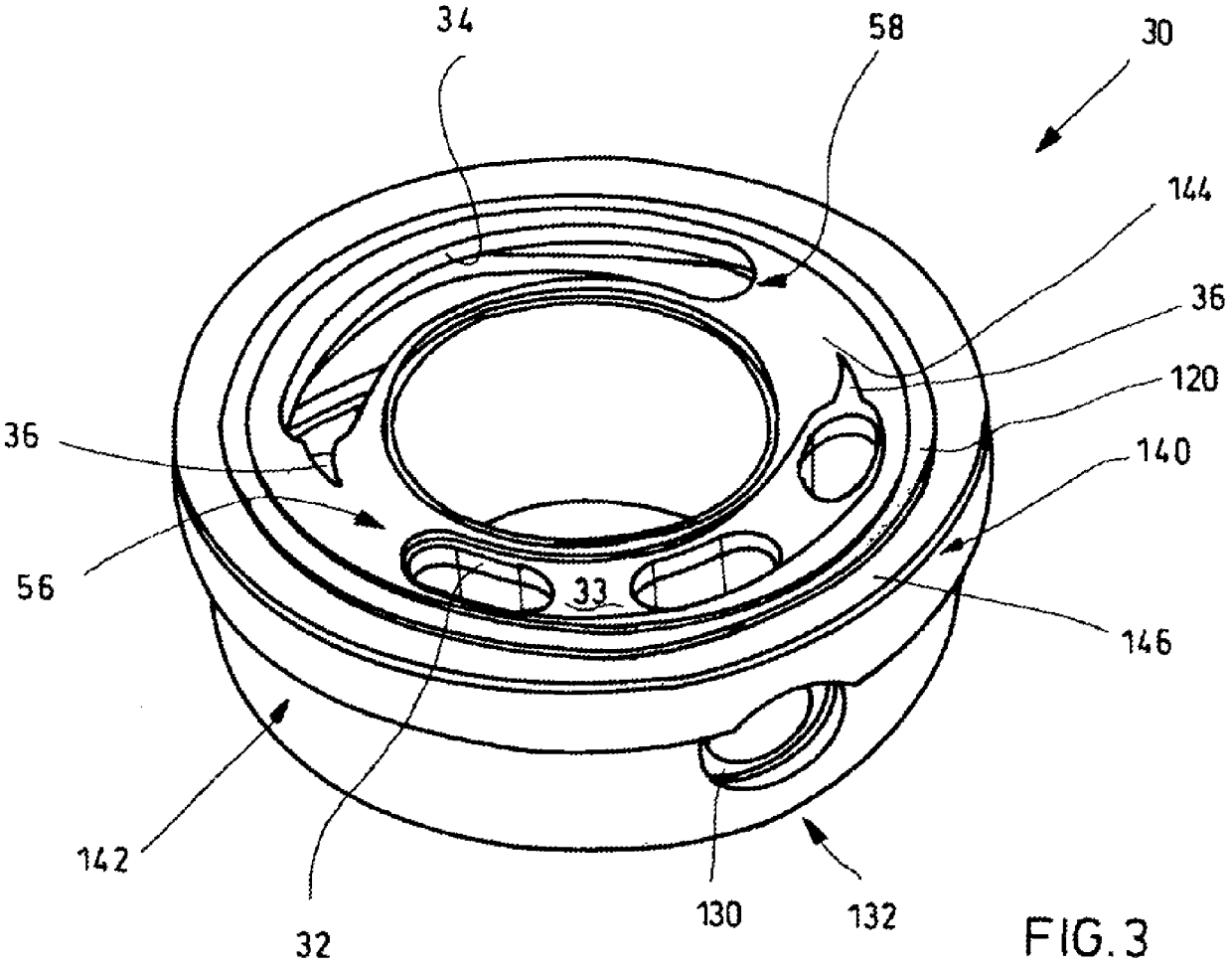
FIG. 3 shows a perspective illustration of a first insert part of the double axial piston pump according to FIGS. 1 and 2, FIGS. 4 and 5 show sectional views of the first insert part of the double axial piston pump according to FIG. 3.
Figure 4:
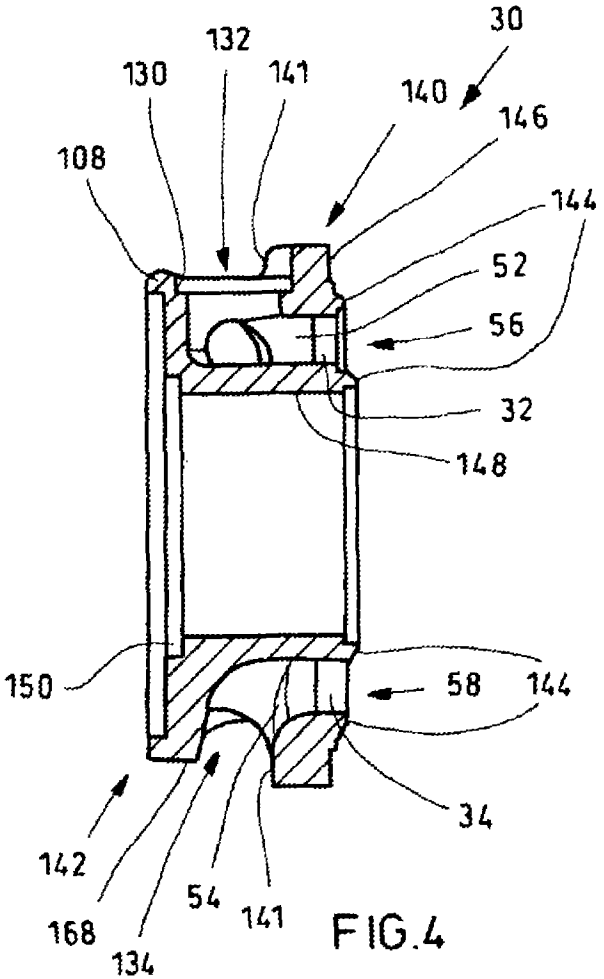
Figure 5:
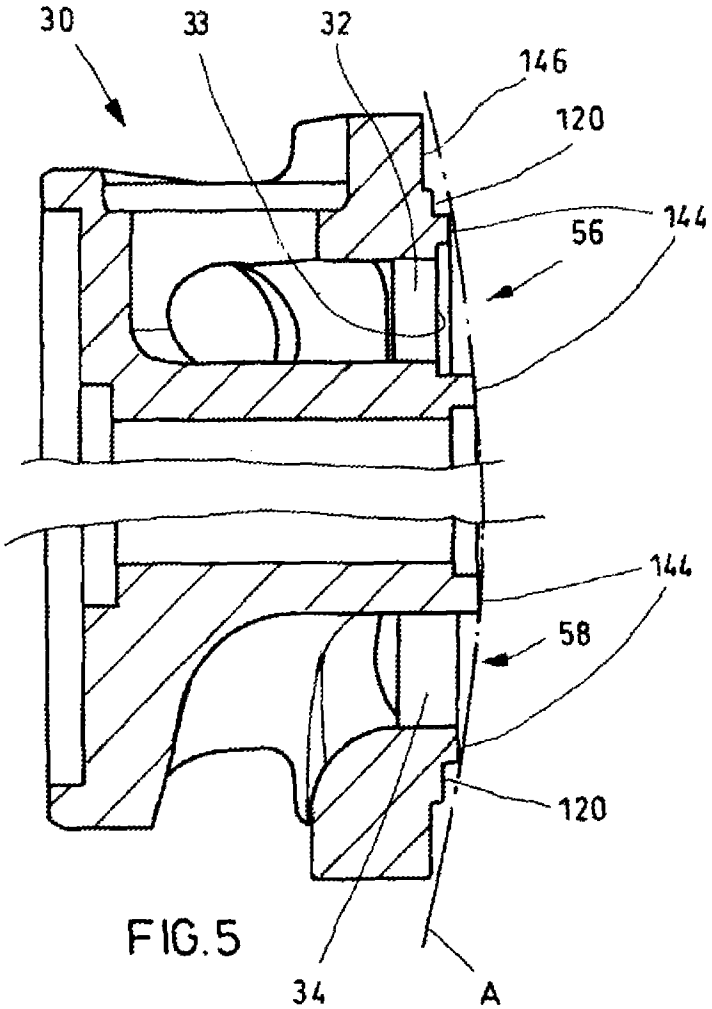
Figure 6:
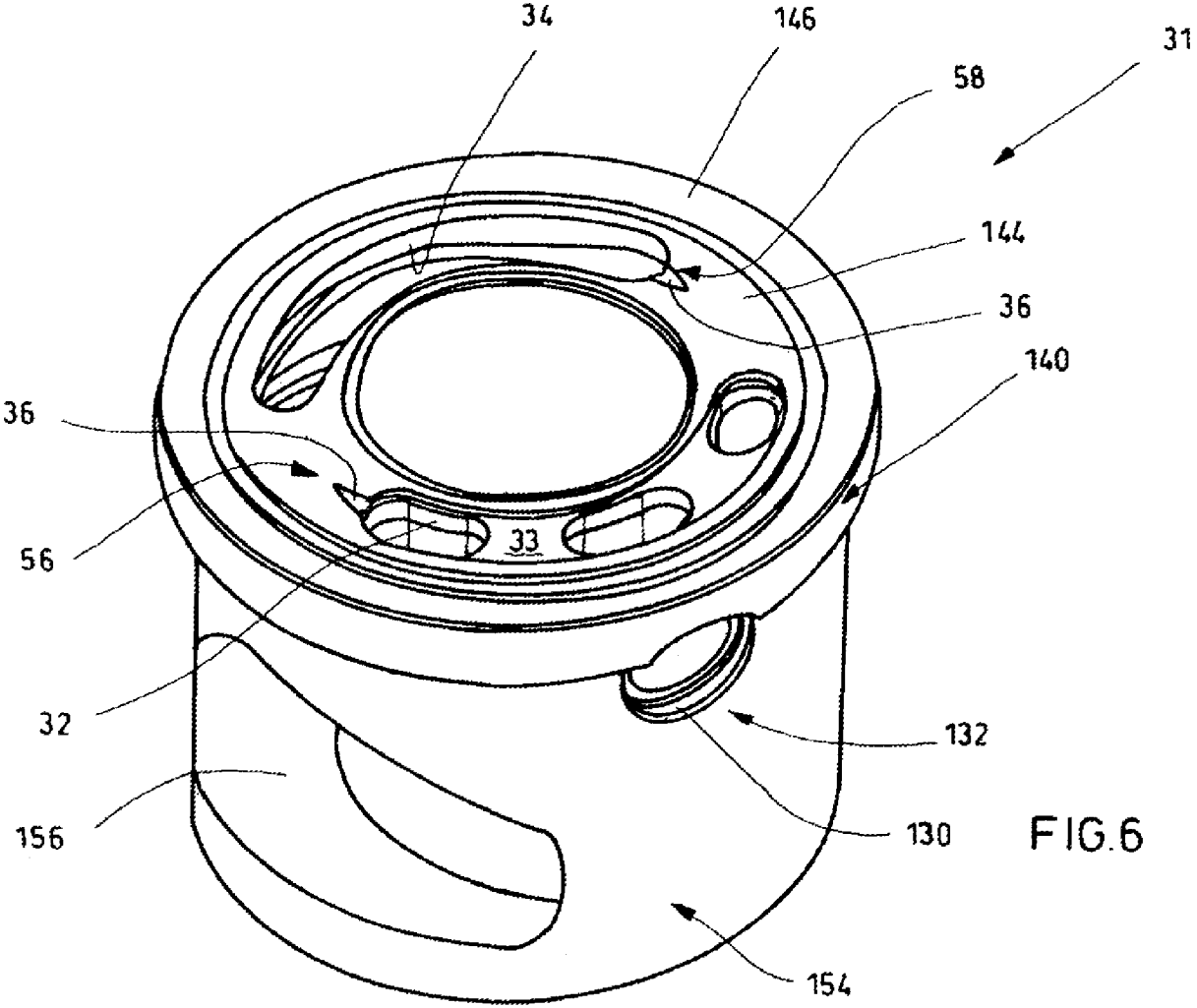
FIG. 6 shows a perspective illustration of a second insert part according to the disclosure of the double axial piston pump according to FIGS. 1 and 2.
Figure 7:
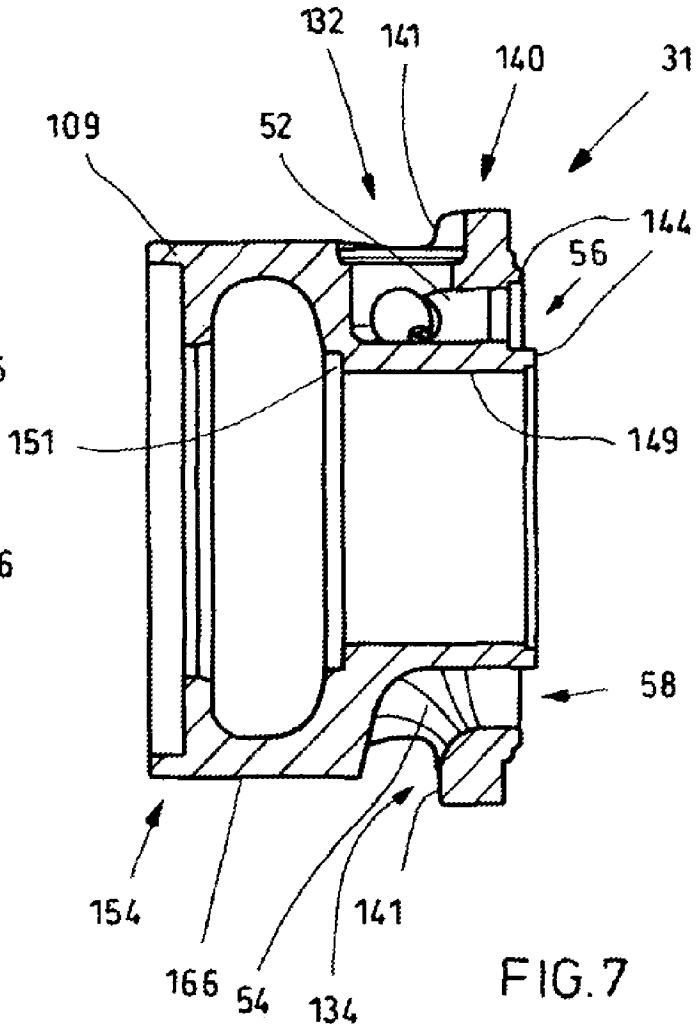
FIG. 7 shows a sectional view of the second insert part of the double axial piston pump according to FIG. 6.
Figure 8:
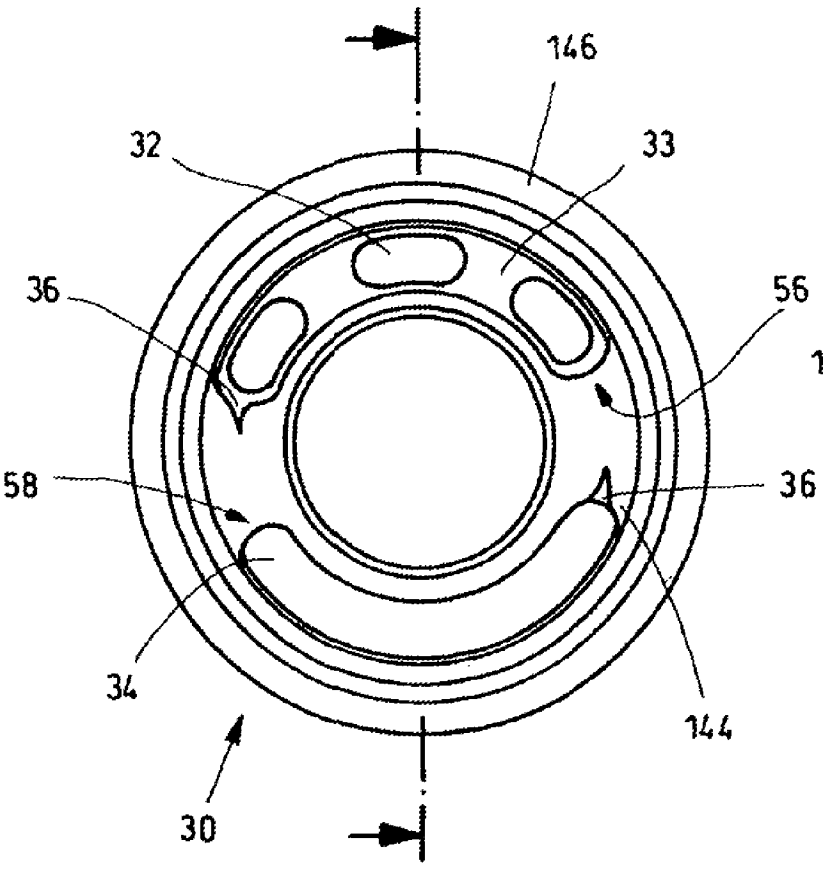
FIG. 8 shows a plan view of an upper side of the insert part which is valid for both insert parts.

Details of the two insert parts 30 and 31 are explained with reference to FIGS. 3 to 8. Here, FIG. 3 shows the basic configuration of the insert part 30 in an overview, and FIGS. 4 and 5 show the insert part 30 in a section and in an enlarged section, respectively. FIG. 6 shows the basic configuration of the somewhat larger insert part 31, and FIG. 7 shows the insert part 31 in a section. FIG. 8 shows a plan view which applies with the exception of the arrangement of the adjustment grooves 36 for the two insert parts 30, 31. The adjustment grooves are indicated in the form in which they are present in the insert part 30 in FIGS. 3 to 5. In the case of the insert part 31, the adjustment grooves are located at the respective other ends of the control kidneys since the direction of rotation of the cylinder drum which bears against the insert part 31 is, with respect to the insert part 31, opposed to the direction of rotation of the other cylinder drum with respect to the insert part 30.

The insert parts 30, 31 are constructed from a comparatively high-strength material, for example from nitrated steel casting, while the housing part 2 can be manufactured from a material with a comparatively small pressure resistance, for example from lightweight metal casting or the like.

FIGS. 3 to 5 explain in the text which follows the configuration of the insert part 30 according to the disclosure in unit 66.

FIG. 3 shows the insert part 30 with a drum-side end section 140 and an impeller-side annular section 142, which is set back radially with respect to the drum-side end section 140. The locating receptacle 130 for the pressure bushing 62 (cf. FIG. 1 or 2) is formed in at least one of the two sections 140 and 142. On an upper side of the insert part 30 or on that side of the drum-side end section 140 which is on the right in FIGS. 4 and 5, an annular spherical control face 144 is formed in such a way that it is slightly raised with respect to another upper side 146. According to the disclosure, in the mounted state of the insert part 30 this control face 144 bears against the end face 28 of the cylinder drum 10 (cf. FIGS. 1 and 2). The narrow annular shape of the control face 144 makes it possible to form, between the cylinder drum 10 and the insert part 30, a defined bearing or contact zone which brings about a good seal and which forms a sliding film with the operating fluid when the parts rotate with respect to one another. The control face 144 is fabricated and ground very precisely here. The same applies for the end face 28, lying opposite the latter, of the cylinder drum 10. Compared to the prior art (cf. DE 195 36 997 C1) in which two individual parts—an insert ring and a thin control disk—perform the function of the insert part 30 which is in one piece according to the disclosure, the insert part 30 has the advantage that both the original shaping, that is to say the molding, and the subsequent processing steps are simplified owing to the size and compactness of the insert part 30.

The axial HP mouth region 56 and the axial LP mouth region 58 are formed in the control face 144. In this context, three pressure kidneys 32 are formed, separated by material webs 33, in the HP mouth region 56. A surface of the material webs 33 is lowered somewhat with respect to the control face 144, as a result of which during operation all three pressure kidneys 32 of the insert part 30 are connected to one another in a pressure medium conducting fashion. The LP mouth region 58 is formed by a large suction kidney 34.

Each mouth region 56, 58 has in each case an adjustment groove 36, as a result of which pressure surges during operation of the double axial piston pump 1 can be reduced. Depending on the direction of rotation, the adjustment groove is located at one or other end of the mouth regions.

FIG. 4 shows a section of the insert part 30 according to FIG. 3, from which the profile of the HP duct section 52 and of the LP duct section 54 is very clear. Accordingly, both duct sections 52, 54 are embodied in an angular shape, wherein the mouth regions 56, 58 each open in the axial direction in the control face 144 of the end section 140. It is clearly apparent that the control face 144 is made very narrow at the locations of the mouth regions 56 and 58 and in addition is not formed parallel to the other upper side 146 of the insert part 30. A mouth 132 which is oriented toward the pressure connection P (cf. FIGS. 1 and 2) and a mouth region 134 which is oriented toward the suction connection T open radially in a circumferential wall in the junction region between the control-side end section 140 and the annular section 142 which is set back radially with respect thereto.

A receptacle 148 for the sliding bearing 86 according to FIGS. 1 and 2 is provided in the insert part 30 via an axial drilled through-hole. Furthermore, on the impeller side a radial backstep 150 of the receptacle 148 is provided in which the annular shoulder 90 of the sliding bearing 86 can dip (cf. FIGS. 1 and 2).

The guide collar 108 (already explained in FIG. 2) which engages around the impeller 84 in certain sections in the circumferential direction is formed in the region of the end face of the annular section 142.

For defined axial positioning of the insert part 30 in the housing section 2*b*, the radial step in the insert part 30 is embodied from the end section 140 toward the annular section 142 in a perpendicular direction with respect to the central axis, as a result of which a bearing face is formed in the form of an annular end face 141. This bearing is ground precisely in the same way as the control face 144 or the end face 28 (cf. FIG. 1).

The insert part 30 according to FIG. 2 is radially centered and mounted in the housing section 2*b* in the axial locating drilled hole 160 provided for this purpose, via an external circumferential face 168.

FIG. 5 shows, for the sake of better illustration of a region of the control face 144, a section through the insert part 30 according to FIG. 4 in an enlarged illustration. A symmetrical central part of the receptacle 148 according to FIG. 4 is cut away here. A dot-dash curve A, which is at a tangent to the control face 144, indicates that the control face 144 is formed a section of a spherical surface. The radius of the dot-dash curve A corresponds here to the radius of the corresponding sphere. In this illustration it is clearly apparent that within the HP mouth region 56 a radial diameter of a pressure kidney 32 is somewhat reduced with respect to a material web 33, which results in the lowering of the control-face-end surface of the material webs 33 with respect to the control face 144, which has already been mentioned in FIG. 3. The LP mouth region 58 is formed by a large suction kidney 34 and does not have such a lowered portion. In the exemplary embodiment shown, the surface of the material webs 33 is formed so as to be planar and perpendicular with respect to the central axis of the insert part 30. In order to increase the pressure resistance of the control face 144, this surface can alternatively be formed from a face which is concentric with respect to the control face 144 and has a slightly reduced radius. In order to reduce a notch effect between the wall of the control face 144 and the upper side 146 of the insert part, the upper side 146 merges with the wall of the control face 144 via a supporting annular step 120.

FIGS. 6 and 7 explain in the text which follows the configuration of the herein disclosed insert part 31 of the unit 68.

FIG. 6 shows the insert part 31 of the unit 68 which is similar in principle to the insert part 30 of the unit 66 according to FIGS. 1 to 5. Features which are of identical configuration therefore have the same reference symbols for the insert part 30.

A drum-side end section 140 has a HP mouth region 56 with a pressure kidney 32, reinforced by material webs 33, and an LP mouth region 58, with a suction kidney 34. On the right-hand side of the drum-side end section 140 in FIG. 7, the annular spherical control face 144 is formed slightly raised with respect to the other upper side 146. One surface of the material webs 33 is somewhat lowered with respect to the control face 144, as a result of which the pressure kidney 32 of the insert part 31 is not interrupted directly in the control face. The LP mouth region 58 is formed by a large suction kidney 34. Each mouth region 56, 58 also has in each case an adjustment groove 36 in a way analogous to the insert part 30.

In the illustration according to FIG. 6, it is also possible to see the locating receptacle 130 for the pressure bushing 62 of the unit 68 (cf. FIG. 2). This locating receptacle 130 opens in an annular section 154 which is significantly longer compared to the insert part 30 and is set back in the radial direction compared to the end section 140 of the insert part 31.

According to the disclosure, in the mounted state of the insert part 31 the control face 144 of the insert part 31 bears against the end face 28 of the cylinder drum 11 (cf. FIGS. 1 and 2). In this context, the same advantages are obtained compared to the prior art as already presented with respect to the insert part 30 in the description according to FIG. 3.

In the illustration according to FIG. 6, a cutout 156 is shown which opens toward the suction chamber, with the result that the pressure medium can flow to the impeller wheel 84 (cf. FIGS. 1 and 2) via this cutout 156.

On the impeller wheel side, according to the sectional illustration in FIG. 7 an end recess is in turn formed in the end face of the annular section 154, the circumferential walls of which end recess form the guide collar 109 for a section of the impeller wheel 84, with the result that the latter forms, as already mentioned, a sealing gap in the radial direction by means of the guide collar 108 on the insert part 30 and the guide collar 109 on the insert part 31. An axial drilled through-hole forms a receptacle 149 for the sliding bearing 87 (cf. FIG. 2) in the insert part 31. Furthermore, a radial backstep 151 of the receptacle 149 is provided on the impeller side, in which backstep the annular shoulder 91 of the sliding bearing 87 (cf. FIG. 2) can dip.

For defined axial positioning of the insert part 31 in the housing section 2*b*, the radial step of the insert part 31 is embodied so as to be perpendicular to the central axis from the end section 140 to the annular section 154, as a result of which a bearing face in the form of an annular end face 141 is formed in a way analogous to the insert part 30 of the unit 66. This bearing is ground precisely, like the control face 144 or the end face 28 of the cylinder drum 11 of the unit 68 (cf. FIG. 1). According to FIG. 2, the insert part 31 bears with its annular end face 141 against the housing part 2.

The insert part 31 according to FIG. 2 in the housing section 2*b* is centered and mounted radially in the axial locating drilled hole 160 provided for this purpose, by means of an external circumferential face 166.

FIG. 8 shows a plan view of the upper side of the insert parts 30, 31 which is valid for both insert parts 30, 31 and which faces the respective end faces 28 of the cylinder drums 10 and 11. The control face 144, the other upper side 146 which is set back axially somewhat, the mouth regions 56 and 58, the pressure kidney 32 and material webs 33, the adjustment grooves 36 and the suction kidney 34 are depicted in a way analogous to FIGS. 3 to 7. In this context, the adjustment grooves are each located at that end of the mouth regions as a function of the direction of rotation that the ducts 27 in the cylinder drum can slowly build up the pressure in the working chamber starting from the suction kidney 34 via the groove 36 of the pressure kidney and can slowly reduce the pressure starting from the pressure kidney via the groove 36 of the low pressure kidney.

An axial piston machine having a housing and a cylinder drum is disclosed, wherein an insert part having an HP duct section is arranged in the housing, said HP duct section changing from an approximately kidney-shaped drum-side HP mouth region into an approximately circular-cylindrical housing-side mouth, wherein the insert part bears directly against the cylinder drum. Furthermore, an insert part for such an axial piston machine is disclosed.

The invention claimed is:

1. A double axial piston machine comprising:

a housing having a common housing part that defines:

an axial bore passing through the common housing part; and a pair of high pressure ducts and a pair of low pressure ducts that extend radially out from the axial bore a pair of insert parts fixedly inserted into opposite ends of the axial bore of the common housing part, each insert part defining:

a control face facing away from the common housing part;

a high pressure duct section having an axial mouth opening through the control face and a cylindrical radial mouth configured to open into a corresponding one of the pair of high pressure ducts in the common housing part;

a low pressure duct section having an axial mouth opening through the control face and a cylindrical radial mouth configured to open into a corresponding one of the pair of low pressure ducts in the common housing part; and a receptacle that is coaxial with the axial bore and passes through the insert part;

a pair of bearings, each bearing received in the receptacle of a corresponding insert part;

a coupling bushing that is coaxial with the axial bore and that is rotatably mounted within the receptacles of the insert parts via the bearings;

a pair of drive shafts coaxial with the axial bore and inserted into opposite ends of the coupling bushing such that the pair of drive shafts and the coupling bushing are rotatably fixed to each other; and a pair of cylinder drums, each cylinder drum defining an end face having a shape complementary to the control face of the corresponding insert part, the cylinder drums mounted in a rotatably fixed fashion to the drive shafts such that the end face of each cylinder drum bears on the control face of the corresponding insert part.

2. The double axial piston machine as claimed in claim 1, wherein for each insert part the axial mouth opening ends in the control face via a fine adjustment geometry.

3. The double axial piston machine as claimed in claim 1, wherein each control face has a spherical shape that extends away from the common housing part.

4. The double axial piston machine as claimed in claim 1, wherein each insert part further defines an annular face that surrounds the control face, the control face being axially raised in a direction relative to the spherical shape relative to the annular face.

5. The double axial piston machine as claimed in claim 1, wherein each of the insert parts includes at least one material web which runs radially across the axial mouth of one of the high pressure duct section and the low pressure duct section.

6. The axial piston machine as claimed in claim 5, wherein a control-face-side surface of the material web is set back with respect to the control face.

7. The double axial piston machine as claimed in claim 1, further comprising:

a locating receptacle formed in the axial mouth of the high pressure duct section of each insert part; and a pressure bushing which is inserted into the locating receptacle, which extends into the housing part and which defines a transition of the high pressure duct section of the corresponding insert part into the common housing part.

8. The double axial piston machine as claimed in claim 1, wherein each insert part further defines a radial backstep having an axial bearing face that is configured to axially bear on the common housing part.

9. The double axial piston machine as claimed in claim 1, wherein each insert part is a steel casting.

10. The double axial piston machine as claimed in claim 1, further comprising a charging pump configured to apply a charging pressure to a pressure medium flowing in on a low pressure side, wherein:

the charging pump is arranged in a region between the cylinder drums, and an impeller wheel of the charging pump forms an axial gap seal at least in certain sections with one or both insert parts.

11. The double axial piston machine as claimed in claim 10, wherein the impeller wheel is connected to the coupling bushing in a rotationally fixed manner.

* * * * *